US011933130B2

(12) United States Patent
Al-Mousa et al.

(10) Patent No.: US 11,933,130 B2
(45) Date of Patent: Mar. 19, 2024

(54) INSTALLING A SHOOTING NIPPLE ON A ROTATING CONTROL DEVICE

(71) Applicant: Saudi Arabian Oil Company, Dhahran (SA)

(72) Inventors: Ahmed Al-Mousa, Dhahran (SA); Ossama A. El-Sokkary, Dhahran (SA); Ossama R. Sehsah, Dhahran (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 59 days.

(21) Appl. No.: 17/652,017

(22) Filed: Feb. 22, 2022

(65) Prior Publication Data

US 2023/0265733 A1 Aug. 24, 2023

(51) Int. Cl.

| | |
|---|---|
| ***E21B 33/072*** | (2006.01) |
| ***E21B 33/08*** | (2006.01) |
| ***E21B 47/07*** | (2012.01) |

(52) U.S. Cl.
CPC ..... *E21B 33/072* (2013.01); *E21B 33/085* (2013.01); *E21B 47/07* (2020.05)

(58) Field of Classification Search
CPC ..... E21B 33/072; E21B 33/085; E21B 47/07
See application file for complete search history.

(56) References Cited

U.S. PATENT DOCUMENTS

| | | | | |
|---|---|---|---|---|
| 3,187,238 A | | 6/1965 | Wilson et al. | |
| 3,885,629 A | | 5/1975 | Erb et al. | |
| 4,203,472 A | | 5/1980 | Dulaney | |
| 4,836,289 A | | 6/1989 | Young | |
| 4,852,648 A | * | 8/1989 | Akkerman | E21B 34/06 439/11 |
| 5,335,730 A | * | 8/1994 | Cotham, III | E21B 34/16 166/374 |
| 5,697,441 A | | 12/1997 | Vercaemer et al. | |
| 6,702,009 B1 | * | 3/2004 | Drury | E21B 29/02 166/212 |
| 7,267,179 B1 | | 9/2007 | Abel | |
| 7,334,634 B1 | | 2/2008 | Abel | |

(Continued)

FOREIGN PATENT DOCUMENTS

| | | |
|---|---|---|
| CA | 2624368 | 4/2011 |
| WO | WO 2011045943 | 4/2011 |
| WO | WO 2013013136 | 1/2013 |

OTHER PUBLICATIONS

U.S. Appl. No. 17/648,082, Al-Mousa, filed Jan. 14, 2022.
U.S. Appl. No. 17/650,476, Al-Mousa, filed Feb. 9, 2022.
U.S. Appl. No. 17/651,268, Al-Mousa et al., filed Feb. 16, 2022.

(Continued)

*Primary Examiner* — Jonathan Malikasim
(74) *Attorney, Agent, or Firm* — Fish & Richardson P.C.

(57) ABSTRACT

A wellhead adaptor tool, a system, and a method for installing a shooting nipple on a rotating control device of a wellhead. The wellhead adaptor tool has a body, a first flange, and a second flange. The body has a void. The first flange is coupled to a first portion of the body. The first flange has multiple voids to couple the body to a shooting nipple by multiple fasteners. The second flange is coupled to a second portion of the body. The second flange couples the body to a rotating control device of a wellhead coupled to a wellbore. A clamp is coupled to the second flange to couple the second flange to the rotating control device.

20 Claims, 6 Drawing Sheets

(56) References Cited

U.S. PATENT DOCUMENTS

| | | | | |
|---|---|---|---|---|
| 7,487,837 | B2 | 2/2009 | Bailey et al. | |
| 7,921,917 | B2 | 4/2011 | Kotrla et al. | |
| 8,424,611 | B2 | 4/2013 | Smith et al. | |
| 9,157,285 | B2 * | 10/2015 | Orbell | E21B 33/02 |
| 9,476,279 | B2 | 10/2016 | Bailey et al. | |
| 9,624,746 | B2 | 4/2017 | Hendel et al. | |
| 9,784,073 | B2 | 10/2017 | Bailey et al. | |
| 10,024,154 | B2 | 7/2018 | Gray et al. | |
| 10,087,701 | B2 * | 10/2018 | Bailey | E21B 21/085 |
| 10,400,552 | B2 | 9/2019 | Gilmore et al. | |
| 10,954,739 | B2 | 3/2021 | Sehsah et al. | |
| 11,008,825 | B2 * | 5/2021 | Fraczek | E21B 33/085 |
| 11,629,559 | B2 * | 4/2023 | Ziegler | E21B 17/021 166/380 |
| 2018/0223621 | A1 * | 8/2018 | McGuire | E21B 33/068 |

OTHER PUBLICATIONS

CCSC, "Bell nipple," CCSC Petroleum Equipment Co., Ltd, 2018, retrieved Mar. 21, 2022, retrieved from URL <ww.ccscpetro.com/bell_nipple_flange.html>, 1 page.

Cudd Energy Services, "Cudd Energy Services Brochure," 2016, 8 pages.

Geodf.com [online], "GEO Drilling Fluids Manual: Drilling Practices to Reduce The Cost of PetroDrill Mud," Geo Drilling Fluids, Inc., available at URL <https://www.yumpu.com/en/document/read/21474235/petrodrill-brochure-geo-drilling-fluids-inc/6>, 1 page.

Katch Kan Limited Catalog, "Upper Katch Kan," 2007, 2 pages.

Katch Kan, "Upper Katch Kan," Katch Kan Brochure, Product Info Sheet, Nov. 2019, 1 page.

Ritchie et al., "Glossary of Petroleum Systems Reliability Analysis," Office of Research and Monitoring and Office of Water Program Operations U.S. Environmental Protection Agency, Aug. 1973, 2 pages.

* cited by examiner

INSTALLING A SHOOTING NIPPLE ON A ROTATING CONTROL DEVICE

TECHNICAL FIELD

This disclosure relates to installing a shooting nipple on a rotating control device of a wellhead on a wellbore, in particular, by using an adaptor tool.

BACKGROUND

Wellheads control a flow of fluids from wellbores drilled in Earth. Some wellheads have pressure control devices such as rotating control devices to seal around a tubular as the tubular passes through the wellhead and rotates. In order to perform some operations in the wellbore during drilling the wellbore or workover, the rotating control device is removed and a shooting nipple is attached to the wellhead to perform the operations.

SUMMARY

This disclosure describes systems and methods related to installing a shooting nipple on a rotating control device of a wellhead.

Wellheads can include rotating control devices to control pressure in wellbores when rotating tubulars such as a drill stings pass through the wellheads into the wellbores. Sometimes, the drill sting has a bottom hole assembly to drill the wellbore, which can become stuck in the wellbore while drilling. In some cases, when the drill sting and bottom hole assembly become stuck in the wellbore, the drill string separates into two portions, one of which remains stuck in the wellbore. In order to position a wireline or slick line fishing assembly into the wellbore to remove the stuck portion of the drill string and bottom hole assembly, the rotating control device is removed from the wellhead and a shooting nipple is installed on the wellhead. The shooting nipple guides the fishing assembly into the wellhead. In some cases, in order to remove the rotating control device, a mud weight of the fluid in the wellbore must be increased to hold pressurized fluids and gases in the formations surrounding the wellbore. Removing the rotating control device and subsequent reinstallation following completion of the fishing operation can be a time and labor intensive task. Also, increasing the mud weight of the fluid in the wellbore can be an expensive and time intensive task.

Sometimes, after drilling a wellbore, a casing is positioned in the wellbore and cement is placed in an annulus defined by an inner surface of the wellbore and the casing. A cement bond log operation can be performed to evaluate the quality of the bond, that is, the sealing quality or effectiveness, of the cement bond between the inner surface of the wellbore and the cement, the properties of the cement, and the cement bod between the cement and the casing. In order to position a cement bond log tool into the wellbore to evaluate the cement bond, the rotating control device is removed from the wellhead and a shooting nipple is installed on the wellhead. The shooting nipple guides the cement bond log tool into the wellhead. Removing the rotating control device and subsequent reinstallation following completion of the cement bond log operation can be a time and labor intensive task.

This approach installs a shooting nipple on a rotating control device of a wellhead by a wellhead adaptor tool. The wellhead adaptor tool has a body with two flanges. The body has a void. One of the flanges has multiple voids to couple the body to the shooting nipple with fasteners. A clamp couples the other flange of the well adaptor tool to the rotating control device of the wellhead.

In one aspect, the wellhead adaptor tool includes a body, a first flange, a second flange, and a clamp. The body includes a void. The first flange is coupled to a first portion of the body. The first flange includes multiple voids. The first flange couples the body to a shooting nipple by multiple fasteners. The second flange is coupled to a second portion of the body. The second flange couples the body to a rotating control device of a wellhead coupled to a wellbore. The clamp couples the second flange to the rotating control device.

In some embodiments, the clamp has a first clamp portion and a second clamp portion coupled to the first clamp portion by a second set of multiple fasteners.

In some embodiments, the void accepts a well tool from the shooting nipple and passes the well tool to the wellhead. In some cases, the well tool is a wireline tool to cut and retrieve a stuck drill pipe in the wellbore or a logging tool to sense wellbore and formation conditions. The void passes the well tool through the wellhead and the rotating control device.

In some embodiments, the wellhead adaptor tool includes a sensor positioned in the body. The sensor senses a condition in the void and transmits a signal representing a value of the condition. In some cases, the sensor includes a pressure sensor.

In some embodiments, the void is cylindrical.

In some embodiments, an inner dimension of the void is between 11 and 18 inches.

In some embodiments, a pressure rating of the body is between 3000 and 15000 pounds per square inch.

In some embodiments, the multiple fasteners are bolts and nuts or studs and nuts.

In another aspect, a wellhead system includes a wellhead of a wellbore, a shooting nipple, an adaptor tool, and clamp. The wellhead of the wellbore includes a rotating control device. The shooting nipple passes a well tool into the wellbore. The adaptor tool couples the shooting nipple to the rotating control device. The clamp couples the adaptor tool to the rotating control device.

In some embodiments, the clamp includes a first clamp portion, a second clamp portion coupled to the first clamp portion, and a second plurality of fasteners coupling the first clamp portion to the second clamp portion.

In some embodiments, the adaptor tool includes a body, a first flange, and a second flange. The body includes a void. The first flange is coupled to a first portion of the body and couples the body to the shooting nipple. The second flange is coupled to a second portion of the body and couples the body to the rotating control device of wellhead. In some cases, the wellhead system further incudes a metal to metal seal between the second flange of the adaptor tool, the clamp, and the rotating control device. In some cases, where the first flange includes multiple voids, the system further includes multiple fasteners to couple the shooting nipple to the adaptor tool.

In some embodiments, the wellhead system further includes a first sensor, a second sensor, and a controller. The first sensor is coupled to the adaptor tool. The first sensor senses a condition of the adaptor tool and transmits a signal representing a value of the condition of the adaptor tool. The second sensor is coupled to the rotating control device. The second sensor senses a condition of the rotating control device and transmits a signal representing a value of the condition of the rotating control device. The controller receives the signal representing the value of the condition of the adaptor tool from the first sensor; receives the signal representing the value of the condition of the rotating control device from the second sensor; compares the value of the condition of the adaptor tool, the value of the condition of the rotating control device, and a threshold value; and based on a result of the comparison, generates an alarm signal. In some cases, where the first sensor includes a pressure sensor and the second sensor includes a pressure and temperature sensor, the condition of the adaptor tool is a pressure of the adaptor tool and the condition of the rotating control device includes a pressure and a temperature of the rotating control device. In some cases, the first sensor is positioned in the adaptor tool to sense the condition of the adaptor tool in an uphole direction from a seal of the rotating control device and the second sensor is positioned in the rotating control device to sense the condition of the rotating control device in a downhole direction from the seal of the rotating control device. In some cases, the wellhead system further includes a display panel to display the pressure of the adaptor tool, the pressure of the rotating control device, the temperature of the rotating control device, and the alarm signal to an operator.

In another aspect, a method of installing a shooting nipple on a rotating control device of a wellhead is described. The method includes receiving an adaptor tool on the rotating control device. The adaptor tool includes a body, a first flange, and a second flange. The body includes a void. The first flange is coupled to a first portion of the body. The first flange includes multiple voids. The first flange couples the body to a shooting nipple by a first set of fasteners. The second flange is coupled to a second portion of the body to couple the body to a rotating control device of wellhead coupled to a wellbore. The method includes coupling the adaptor tool to the rotating control device by a clamp. The method includes coupling the shooting nipple to the adaptor tool by the multiple fasteners.

In some embodiments, coupling the adaptor tool to the rotating control device by the clamp includes separating a first clamp portion of the clamp from a second clamp portion of the clamp; positioning the first clamp portion and the second clamp portion about a flange of the rotating control device and the second flange of the adaptor tool; and coupling the first clamp portion to the second clamp portion by a second set of fasteners.

Implementations of the present disclosure can realize one or more of the following advantages. These systems and methods can improve personnel and environmental safety. For example, installing the shooting nipple and adaptor tool onto the rotating control device of the wellhead can maintain stable wellbore pressure control and reduce the likelihood of an uncontrolled wellbore pressure increase which could harm personnel and/or contaminate the environment. Maintaining the rotating control device on the wellhead can reduce the release of fluids to the environment.

These systems and methods can reduce the time required to install the shooting nipple on the wellhead. For example, the rotating control device no longer must be removed to install a shooting nipple on the wellhead since the adaptor tool couples to both the rotating control device and the shooting nipple.

These systems and methods also can decrease the time required to drill a wellbore. For example, when the drill string is stuck in the wellbore while drilling and the drill string separates into two portions with one portion stuck in the wellbore, the rotating control device does not need to be removed to attach the shooting nipple to the wellhead to enable the wireline or slickline fishing assembly to pass into the wellbore to remove the stuck portion of the drill string and bottom hole assembly. For example, since the rotating control device no longer needs to be removed to install the shooting nipple, the mud weight of the fluid in the wellbore no longer needs to be increased to hold pressurized fluids and gases in the formations surrounding the wellbore, which can be a time intensive task.

These systems and methods can reduce time required to perform wellbore logging operations. For example, a logging tool can be run on a wireline assembly instead of drill pipe. For example, the logging tool can be run on a slick line tool with a barrier or a stuffing box instead of drill pipe.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

The present disclosure relates to installing a shooting nipple on a rotating control device of a wellhead by an adaptor tool.

This approach installs a shooting nipple on a rotating control device of a wellhead using an adaptor tool and a clamp. The adaptor tool has a body with a first and second flange. The body has a void which can accept a well tool from the shooting nipple and pass the well tool to the wellhead. The first flange is coupled to a first portion of the body and couples the body to the shooting nipple. The first flange has multiple voids to accept fasteners to couple the first flange to the shooting nipple. The second flange is coupled to a second portion of the body and couples the body to the rotating control device. The clamp couples the second flange to the rotating control device.

When drilling or performing a workover operation on a wellbore, a wellhead is installed on the wellbore to control wellbore fluid flow and pressure in wellbore. The wellhead can include a rotating control device to seal around the tubulars (such as a drill string) and control pressure in the wellbore with the tubulars rotating and passing through the wellhead into the wellbore. During drilling, the drill sting can become stuck in the wellbore and separate into two portions, one of which remains stuck in the wellbore. In order to dispose a wireline or slick line fishing assembly into the wellbore to remove the stuck portion of the drill string, the shooting nipple can be installed on the rotating control device by the adaptor tool. The shooting nipple guides the fishing assembly into the wellhead.

Figure 1:
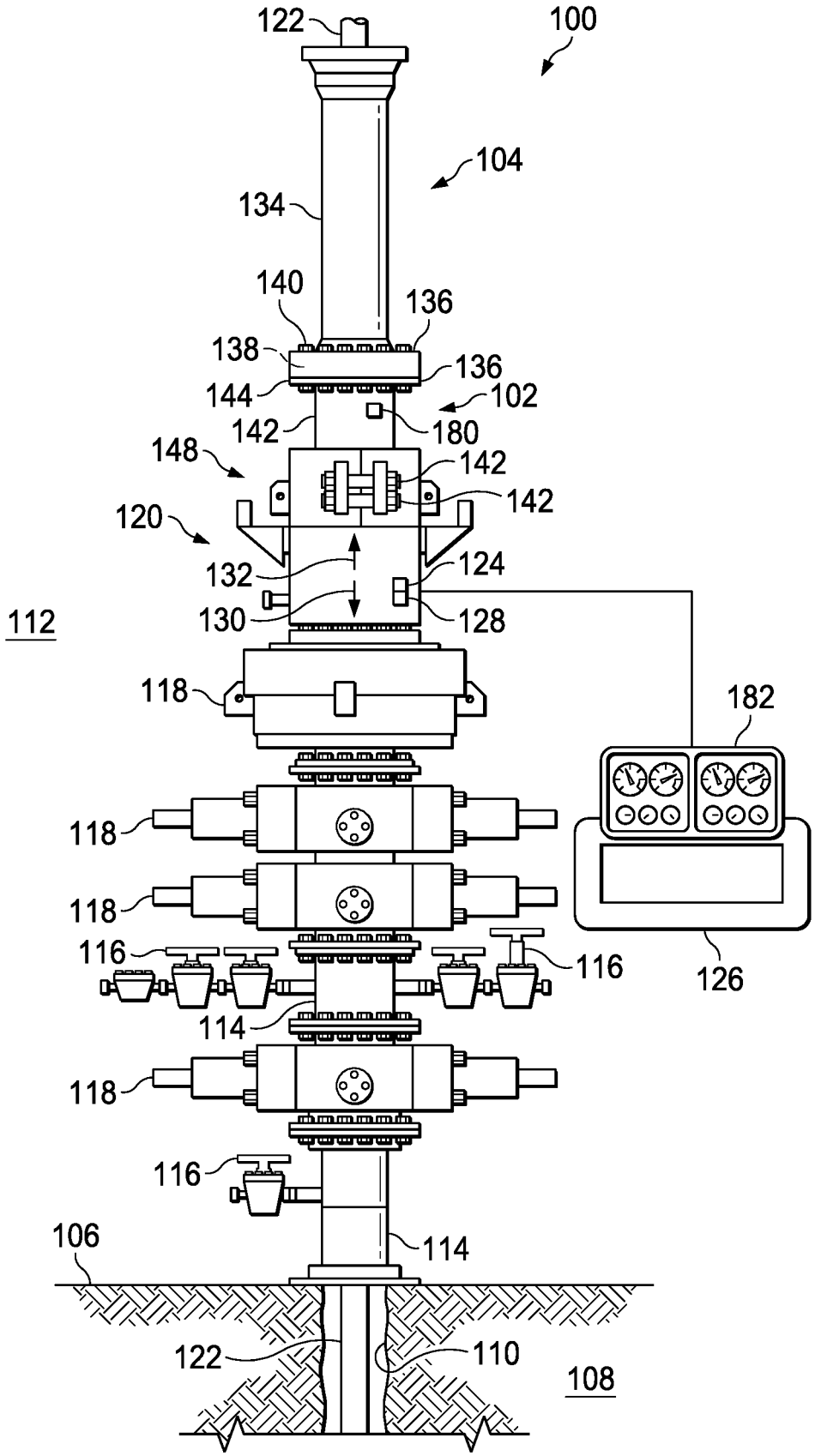
FIG. 1 is a schematic front view of a wellhead system including a shooting nipple, an adaptor tool, and a rotating control device.

FIG. 1 is a schematic front view of a wellhead including a shooting nipple, an adaptor tool, and a rotating control device. Referring to FIG. 1, the wellhead system 100 has an adaptor tool 102 which couples a shooting nipple 104 to the wellhead system 100.

The wellhead system 100 is positioned on a surface 106 of the Earth 108 and coupled to a wellbore 110 extending from the surface 106 of the Earth 108. The wellhead system 100 controls the flow of fluids such as water and hydrocarbons in liquid and gas form in the wellbore 110 to the surrounding environment 112. The wellhead system 100 is a pressure barrier. The wellhead system 100 has spools 114 and valves 116 to control and direct the flow of fluid into and out of the wellbore 110. The wellhead system 100 has blowout preventers 118 to seal the wellbore 110 from the environment 112.

The wellhead system 100 has a rotating control device 120 to seal around a tubular 122. The rotating control device 120 sealing around the tubular 122 prevents pressurized wellbore fluid from exiting the wellbore 110 through the wellhead system 100 into the environment 112. The rotating control device 120 seals around the tubular 122 when the tubular is stationary or rotating.

Figure 2:
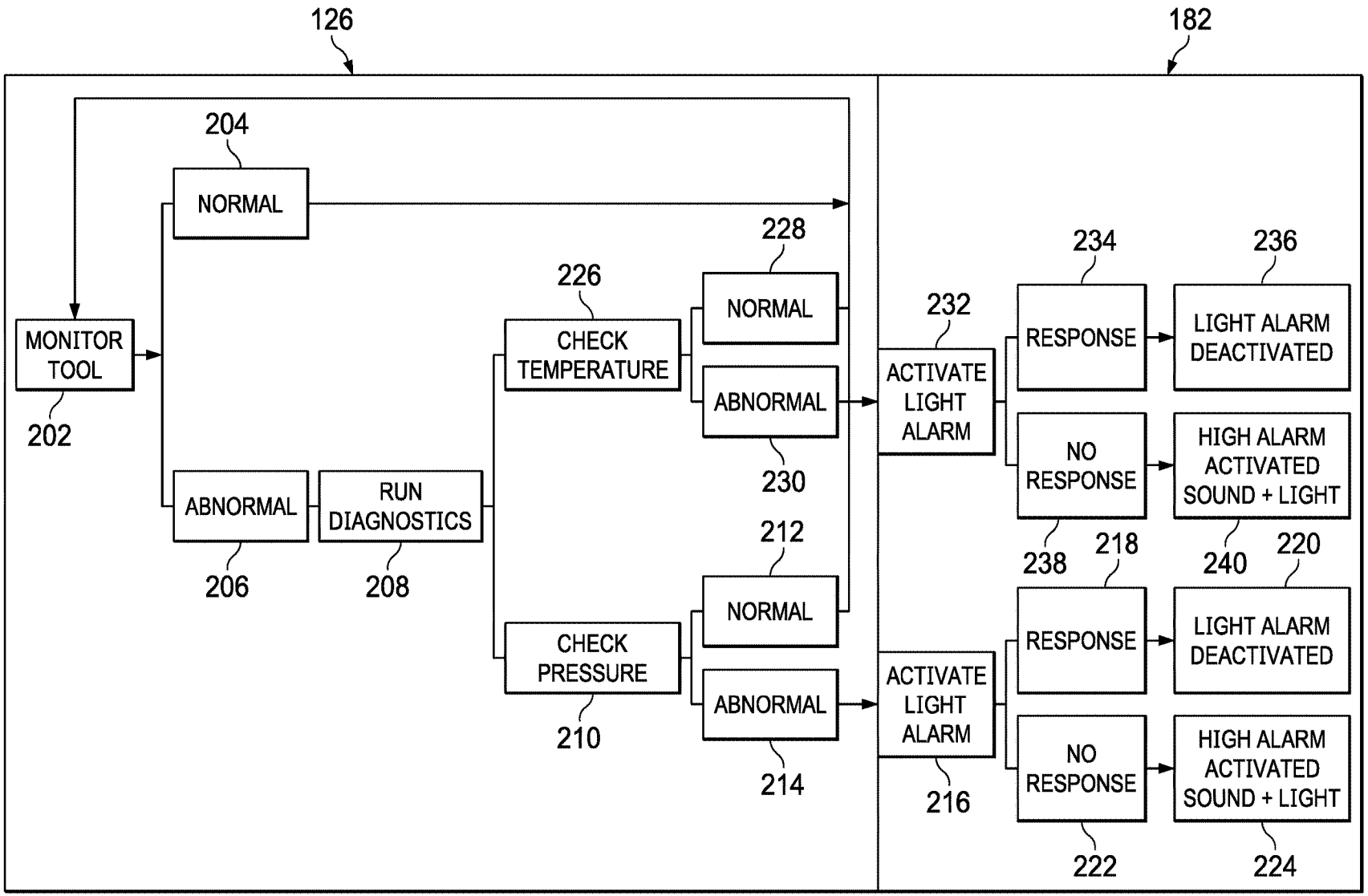
FIG. 2 is a schematic view of a controller of the wellhead system.

The rotating control device 120 has a pressure sensor 124 which senses a pressure in the rotating control device 120 and transmits a signal representing the value of the pressure to a controller 126, described in more detail later in reference to FIG. 2. FIG. 2 is a schematic view of a controller of the wellhead system. The rotating control device 120 has a temperature sensor 128 which senses a temperature in the rotating control device 120 and transmits a signal representing the value of the temperature to the controller 126. The pressure sensor 124 and the temperature sensor 128 sense the respective conditions in a downhole direction 130 from a rotating seal (not shown) which seals against the tubular 122. In this configuration, the downhole direction 130 from the rotating seal is the pressure and temperature of the wellbore 110. In some implementations, the pressure sensor 124 and temperature sensor 128 can be positioned in the rotating control device in an uphole direction 132 from the rotating seal.

The shooting nipple 104 passes the tubular 122 through the wellhead system 100 into the wellbore 110. The shooting nipple 104 can connect between various wellhead components and pressure control equipment to allow a well tool such as workover assembly to pass into the wellbore. For example, the tubular 122 can be a drill pipe or a completion tubing. For example, the tubular 122 can be a well tool such as a wireline assembly, a slick line assembly, a logging and measurement assembly, or a fishing assembly. The shooting nipple 104 has a hollow cylinder 134 defining a void 152 coupled to a flange 136. The hollow cylinder 134 is sized to align and quickly pass the tubular 122 through the wellhead system 100 in to the wellbore. For example, the void 152 of the shooting nipple 104 can have an inner diameter 162 (shown in reference to FIGS. 3A-3E) of between 11 and 18 inches. The flange 136 is sized and configured to attach the shooting nipple 104 to the adaptor tool 102. The flange 136 has voids 138 which allow fasteners 140 to pass through to couple to the adaptor tool 102. For example, the fasteners 140 can be bolts and nuts or studs and nuts. The shooting nipple 104 can be metallic. For example, the shooting nipple 104 can be steel, aluminum, or an alloy.

FIGS. 3A-3E are schematic front views illustrating installing a shooting nipple on a rotating control device of a wellhead by an adaptor tool. Referring to FIGS. 1 and 3A-3E, the adaptor tool 102 has a body 142 with a first flange 144 coupled to a first portion 156 of the body 142 and a second flange 146 (shown in FIGS. 3A-3C) coupled to a second portion 158 the body 142. The first flange 144 couples the adaptor tool 102 to the flange 136 of the shooting nipple 104. Referring to FIGS. 3A-3D, the first flange 144 has multiple voids 160 to accept the fasteners 140 to couple the shooting nipple 104 to the adaptor tool 102. A clamp 148 couples the second flange 146 to a flange 150 of the rotating control device 120.

The adaptor tool 102 can be metallic. For example, the adaptor tool can be steel, aluminum, and an alloy. The adaptor tool 102 can have a pressure rating of between 3000 and 15000 pounds per square inch.

As shown in FIGS. 3A-3E, the body 142 has a void 154 extending from the first portion 156 of the body 142 to the second portion 158 of the body 142. The void 154 can be cylindrical. The void 154 is sized to accept the tubular 122 (a well tool) from the shooting nipple 104 and pass the tubular 122 through the body 142 to the wellhead system 100. The void 154 of the adaptor tool 102 can have an inner diameter 164 (shown in reference to FIG. 3A) of between 11 and 18 inches.

Figure 3A:
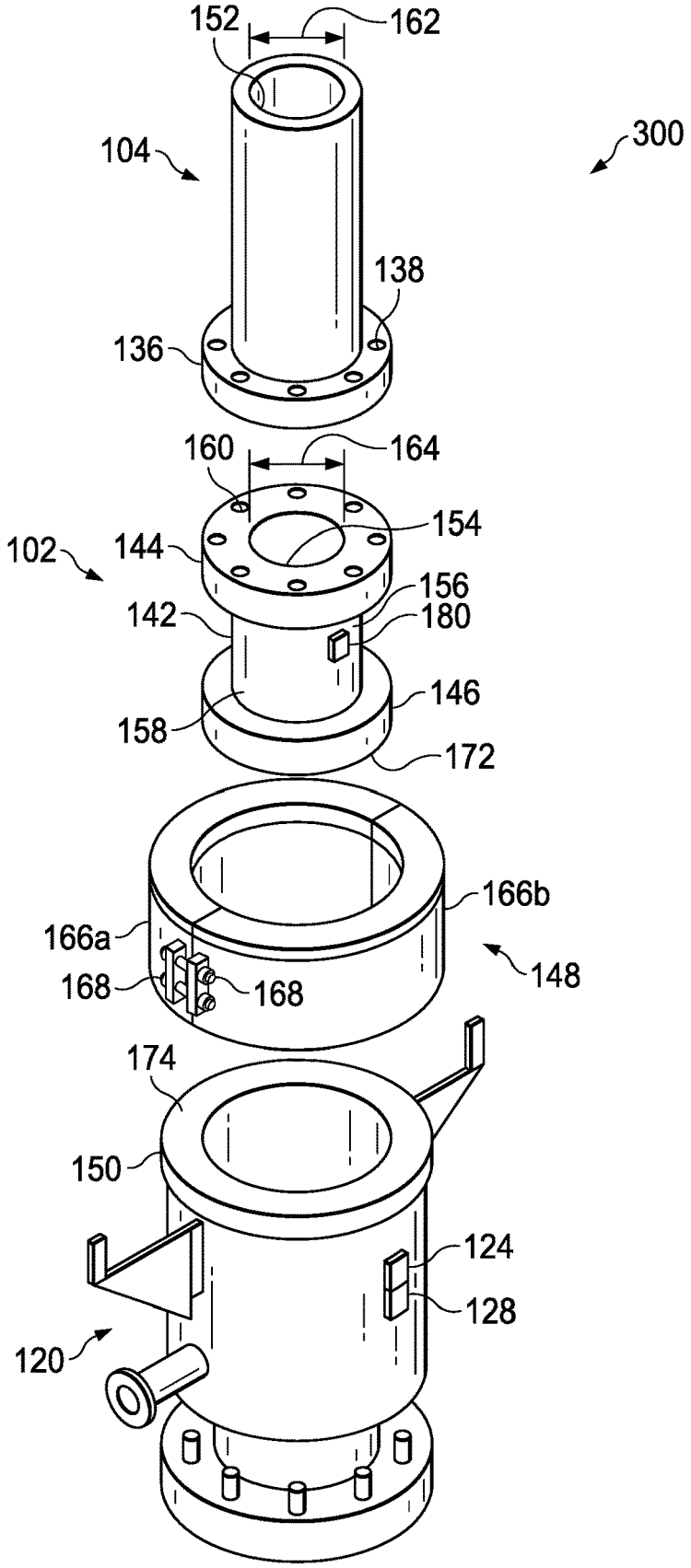
FIGS. 3A-3E are schematic front views illustrating installing a shooting nipple on a rotating control device of a wellhead by an adaptor tool.
Figure 3B:
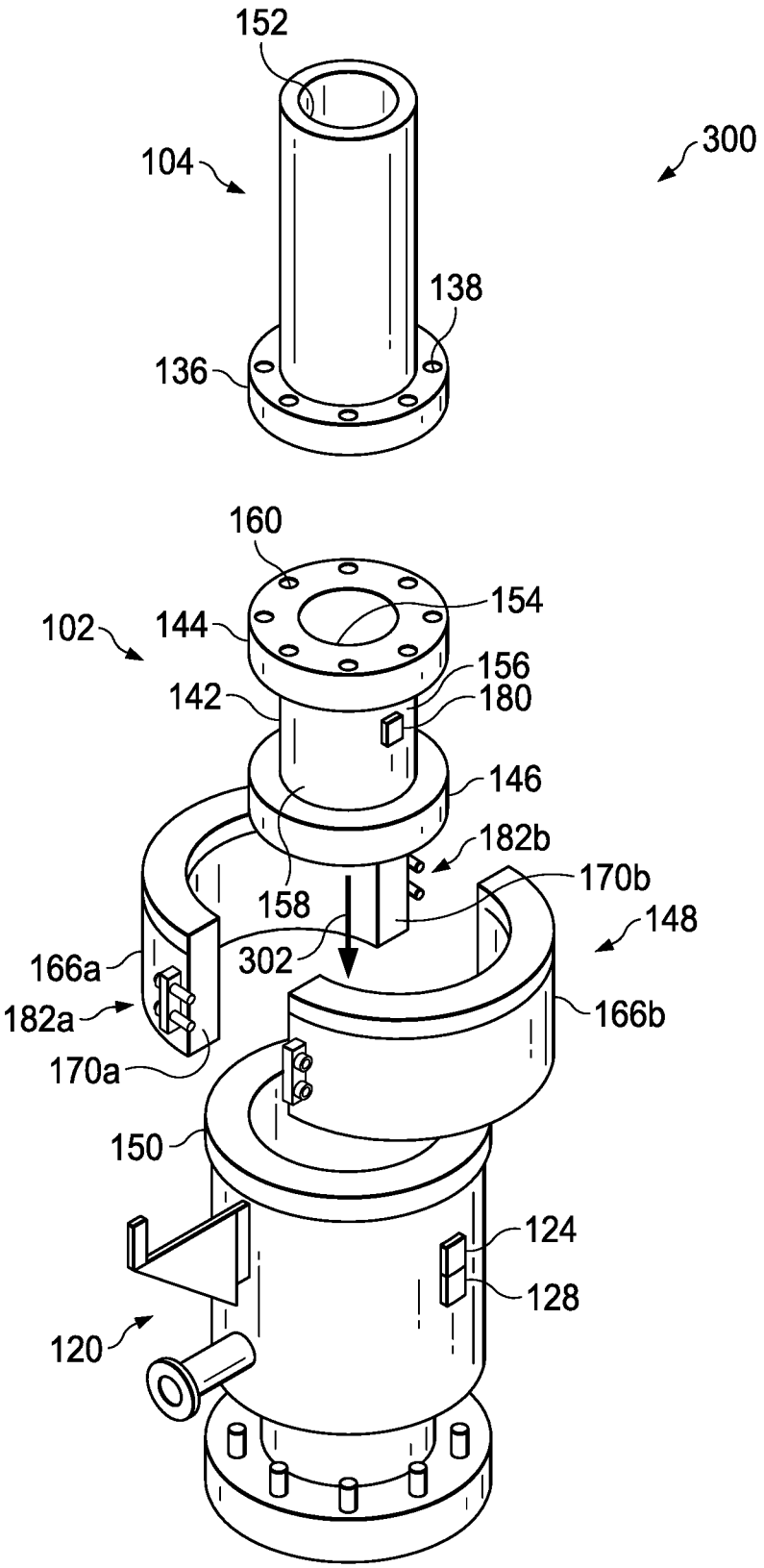

Referring to FIGS. 1 and 3A-3E, the clamp 148 couples the second flange 146 of the adaptor tool 102 to the flange 150 of the rotating control device 120. The clamp 148 has two portions **166*a*, 166*b* to couple the adaptor tool 102 to the rotating control device 120. In some implementations, not shown, the clamp 148 may have three or more portions 166*a*, 166*b*. As shown in FIGS. 3A-3E, the two portions 166*a*, 166*b* are sized to extend entirely around the second flange 146 of adaptor tool 102 and the flange 150 of the rotating control device 120. However, in other implementations, the two portions 166*a*, 166*b* may not extend completely around the second flange 146 of adaptor tool 102 and the flange 150 of the rotating control device 120. The clamp 148 has fasteners 168 to couple the two portions 166*a*, 166*b* together. The fasteners 168 can be arranged in multiple fastener sets 182*a*, 182*b* on opposite sides 170*a*, 170*b* of the claim 148 (as shown in FIG. 3B). Alternatively, one fastener set 182*a*** can be replaced by a hinge.

Figure 3C:
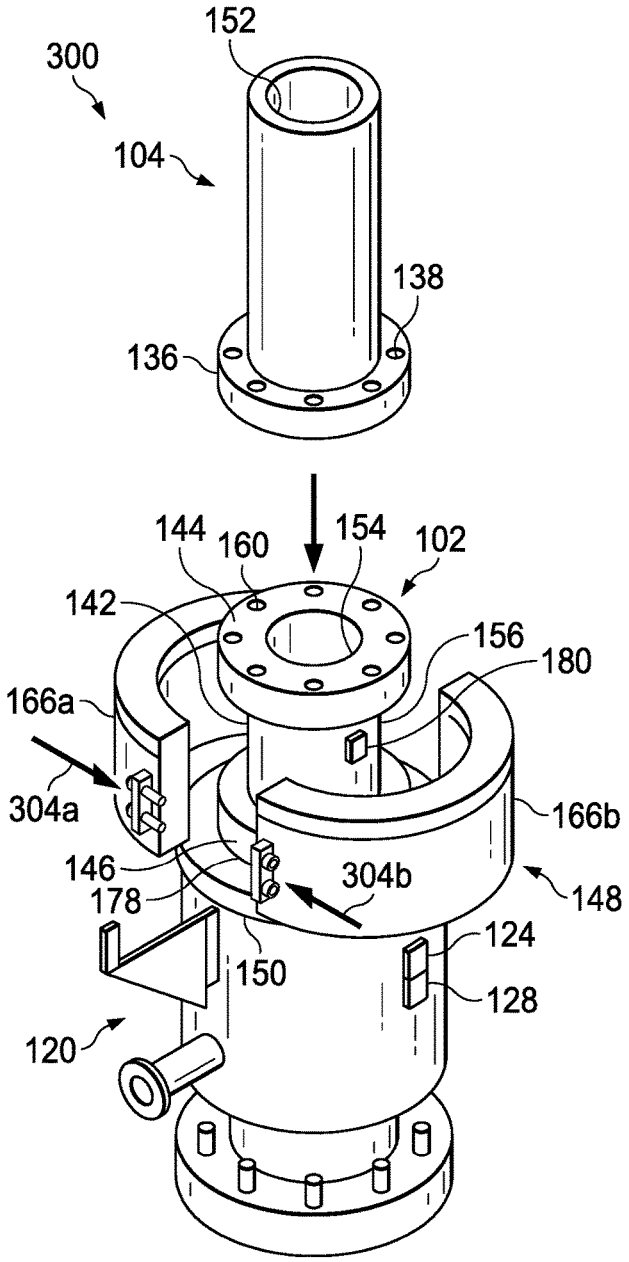

Referring to FIGS. 3A and 3C, in some cases, a surface 172 of the second flange 146, a surface 174 of the flange 150 of the rotating control device 120, and an inner surface 176 of the clamp 148 define a metal to metal seal 178 (shown in FIG. 3C).

The tool adaptor 102 has a sensor 180 positioned in the body 142 to sense a condition of the void 154 and transmit a signal representing a value of the condition to the controller 126. The sensor 180 can be a pressure sensor to sense a pressure in the void 154.

Referring to FIGS. 1 and 2, a system 200 and components of the controller 126 and the display panel 182 for monitoring the pressures and temperatures of the rotating control device 120 and the adaptor tool 102 are illustrated. The controller 126 has a tool monitor processor 202 to receive and compare the signal representing the value of the pressure in the rotating control device 120 from the pressure sensor 124 the signal representing the value of the pressure in the void 154 of the adaptor tool 102 from the pressure sensor 180 to a threshold value. The tool monitor processor 202 receives the signal representing the value of the temperature in the rotating control device 120 from the temperature sensor 128 and compares the temperature value to a temperature threshold. When the result of the comparison indicates a normal condition 204, the tool monitor processor 202 continues to monitor the pressures and temperature.

When the result of the comparison indicates an abnormal condition 206, the controller enters a run diagnostic state 208.

In the run diagnostics state 208 and the pressure is abnormal condition 206, the controller 126 enters a check pressure state 210. The controller 126 receives the signal representing the value of the pressure in the rotating control device 120 from the pressure sensor 124. The controller 126 receives the signal representing the value of the pressure in the void 154 of the adaptor tool 102 from the pressure sensor 180. The controller 126 then compares the value of the pressure in the rotating control device 120 to the value of the pressure in the void 154 of the adaptor tool 102 to a threshold value. The threshold value can be a pressure differential threshold. For example, the pressure differential threshold can be between 1500 and 3000 pounds per square inch. The pressure differential threshold can indicated a quality or an effectiveness of the seal of the rotating control device 120 against the tubular 122. When the result of the comparison between the value of the pressure in the rotating control device 120 to the value of the pressure in the void 154 of the adaptor tool 102 is less than the threshold value, the controller 126 enters a normal state 212 and returns to monitoring the pressure for the normal condition 204 or the abnormal condition 206.

Based on the result of the comparison between the value of the pressure in the rotating control device 120 to the value of the pressure in the void 154 of the adaptor tool 102 exceeding the threshold value, the controller 126 can generate an abnormal state 214. The abnormal state 214 generates a pressure alarm (either audible, visual, or both) 216 on the display panel 182. The difference between the value of the pressure in the rotating control device 120 to the value of the pressure in the void 154 of the adaptor tool 102 compared to the threshold value can indicate a degradation in the seal quality or a seal failure. In other words, the pressure sensor 180 of the adaptor tool 102 senses pressure in the uphole direction 132 from the seal of the rotating control device 120 and the pressure sensor 124 of the rotating control device 120 senses pressure in a downhole direction 130 from the seal of the rotating control device. The display panel 182 can show the value of the pressure in the rotating control device 120 from the pressure sensor 124, the value of the pressure in the void 154 of the adaptor tool 102 from the pressure sensor 180, and the alarm 216 indicating that the comparison between the value of the pressure in the rotating control device 120 to the value of the pressure in the void 154 of the adaptor tool 102 has exceeded the threshold value to an operator.

The operator can acknowledge the pressure alarm 216. When the operator responds to the pressure alarm 216, the display panel generates a response state 218. When the display panel generates the response state 218, the pressure alarm 216 is deactivated 220. When the operator does not respond to the pressure alarm 216, the display panel generates a no response state 222. When the display panel 182 generates the no response state, a second pressure alarm 224 is generated. For example, an audible alarm of a different tone, sequence, or volume can be generated. For example, a visual light of a different color, brightness, or pattern can be generated.

The tool monitor processor 202 receives, monitors, and compares the temperature from the temperature sensor 128. When the result of the comparison indicates a normal condition 204, the tool monitor processor continues to monitor the pressures and temperature. When the result of the comparison indicates the abnormal condition 206, the controller enters a run diagnostic state 208. In the run diagnostics state 208 and the temperature is abnormal, the controller 126 enters a check temperature state 226. The controller 126 receives the signal representing the value of the temperature in the rotating control device 120 from the temperature sensor 128. The temperature sensor 128 can sense the temperature of the seal of the rotating control device 120. The controller 126 then compares the value of the temperature of the seal in the rotating control device 120 to a threshold value. The threshold value can be a temperature threshold, such as a high temperature limit or a maximum operating temperature range specified by a manufacturer. The temperature threshold can indicated a quality or an effectiveness of the seal of the rotating control device 120 against the tubular 122.

When the result of the comparison between the value of the temperature of the seal of the rotating control device 120 is less than the threshold value, the controller 126 enters a normal state 228 and returns to monitoring the temperature for the normal condition 204 or the abnormal condition 206. Based on the result of the comparison between the value of the temperature of the seal in the rotating control device 120 temperature threshold value, the controller 126 can generate an abnormal state 230. The abnormal state 230 generates a temperature alarm 232 (either audible, visual, or both) on the display panel 182. The temperature of the seal of the rotating control device 120 reaching or exceeding the threshold value can indicate a degradation in the seal quality or a seal failure. The display panel 182 can show the value of the temperature of the seal in the rotating control device 120 and the alarm indicating that temperature of the seal of the rotating control device 120 has reached or exceeded the threshold value to the operator.

The operator can acknowledge the temperature alarm 232. When the operator responds to the temperature alarm 232, the display panel generates a response state 234. When the display panel generates the response state 234, the temperature alarm 232 is deactivated 236. When the operator does not respond to the alarm, the display panel generates a no response state 238. When the display panel 182 generates the no response state, a second temperature alarm 240 is generated. For example, an audible alarm of a different tone, sequence, or volume can be generated. For example, a visual light of a different color, brightness, or pattern can be generated.

Figure 3D:
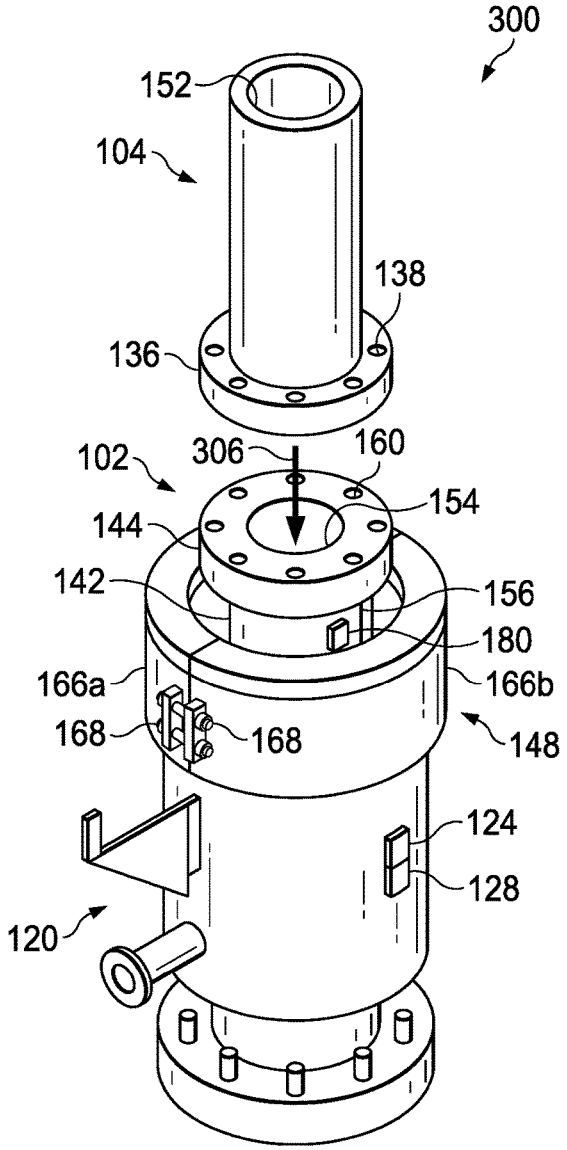
Figure 3E:
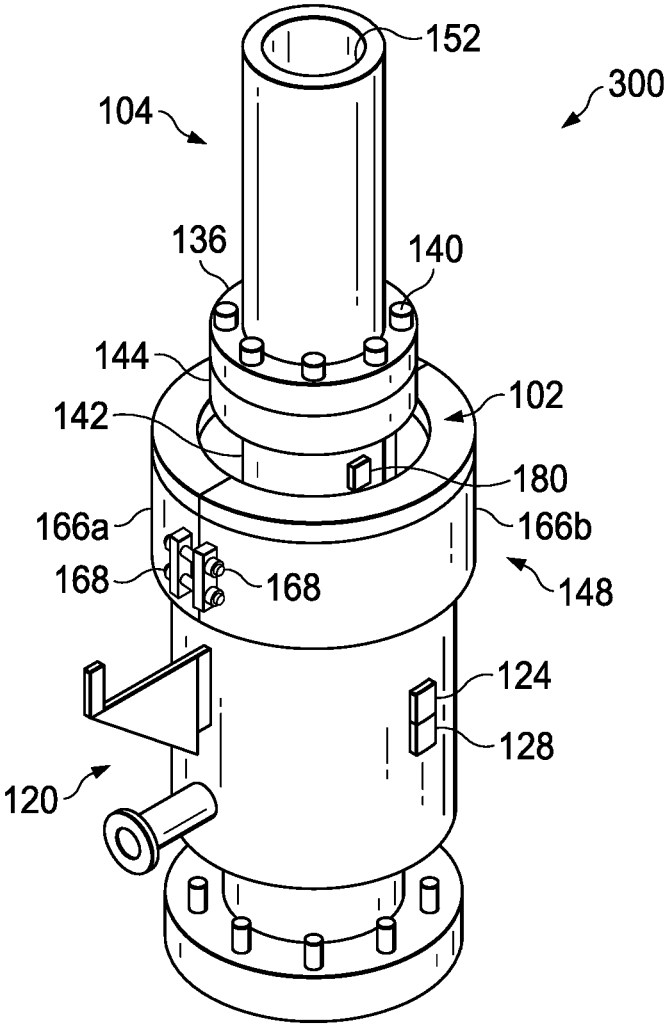
Figure 4:
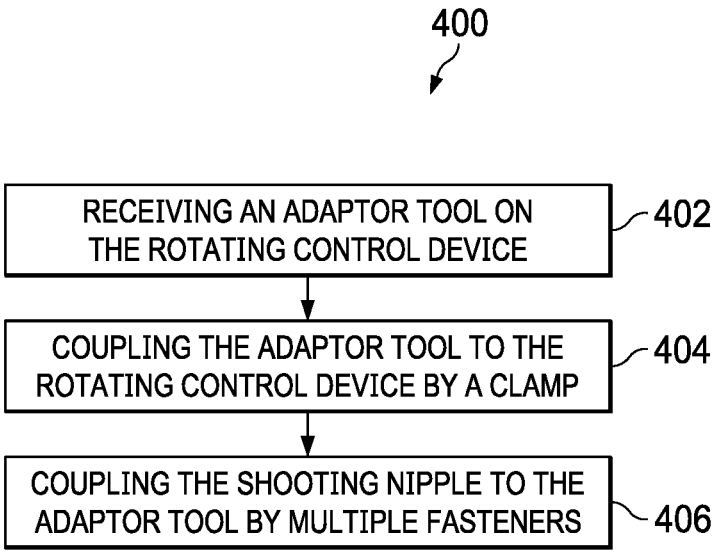
FIG. 4 is a flow chart of an example method of installing a shooting nipple on a rotating control device of a wellhead by an adaptor tool.

FIG. 4 is a flow chart 400 of an example method of installing a shooting nipple on a rotating control device of a wellhead by an adaptor tool. FIGS. 3A-3E illustrate installing the shooting nipple 104 on the rotating control device 120 by the adaptor tool 102.

At 402, an adaptor tool is received on the rotating control device. The adaptor tool has a body, a first flange, and second flange. The body has a void. The first flange is coupled to a first portion of the body. The first flange has multiple voids. The first flange couples the body to a shooting nipple by multiple fasteners. The second flange is coupled to a second portion of the body. The second flange couples the body to a rotating control device of wellhead coupled to a wellbore. Referring to FIG. 3A, the adaptor tool 102 is positioned and aligned relative to the rotating control device 120. The adaptor tool 102 is moved toward the rotating control device 120 in the direction of arrow 302. Referring to FIG. 3B, the surface 172 of the second flange 146 contacts the surface 174 of the flange 150 of the rotating control device 120.

At 404, the adaptor tool is coupled to the rotating control device by a clamp. Coupling the adaptor tool to the rotating control device by the clamp can include separating a first clamp portion of the clamp from a second clamp portion of the clamp, positioning the first clamp portion and the second clamp portion about a flange of the rotating control device and the second flange of the adaptor tool, and coupling the first clamp portion to the second clamp portion by multiple fasteners. Referring to FIG. 3B, fasteners 168 holding the clamp 148 together are disconnected and the portions 166*a*, 166*b* of the clamp 148 are separated. The portions 166*a*, 166*b* of the clamp 148 are positioned about the flange 150 of the rotating control device 120 and the second flange 146 of the adaptor tool 102. Referring to FIG. 3D, the portions 166*a*, 166*b* are coupled together about the flange 150 of the rotating control device 120 and the second flange 146 of the adaptor tool 102 in the direction of arrows 304*a*, 304*b* by the fasteners 168. At 406, the shooting nipple is coupled to the adaptor tool by the multiple fasteners. Referring to FIG. 3D, the shooting nipple 104 is positioned, aligned, and moved toward the first flange 144 of the adaptor tool 102 in the direction of arrow 306. Referring to FIG. 3E, the shooting nipple 104 contacts the adaptor tool 102. The fasteners 140 are placed through the voids 138 of the shooting nipple 104 and the voids 160 of the first flange 144.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A wellhead adaptor tool comprising:

a body comprising a void;

a first flange coupled to a first portion of the body, the first flange comprising a plurality of voids, the first flange configured to couple the body to a shooting nipple by a plurality of fasteners;

a second flange coupled to a second portion of the body, the second flange configured to couple the body to a rotating control device of a wellhead coupled to a wellbore; and a clamp coupled to the second flange, the clamp configured to couple the second flange to the rotating control device, wherein the clamp comprises:

a first clamp portion; and a second clamp portion coupled to the first clamp portion by a second plurality of fasteners.

2. The wellhead adaptor tool of claim 1, wherein the void of the body is configured to:

accept a well tool from the shooting nipple; and pass the well tool to the wellhead.

3. The wellhead adaptor tool of claim 2, wherein the well tool comprises at least one of a wireline tool configured to cut and retrieve a stuck drill pipe in the wellbore or a logging tool configured to sense wellbore and formation conditions, the void configured to pass the well tool through the wellhead and the rotating control device.

4. The wellhead adaptor tool of claim 1, further comprising a sensor positioned in the body, the sensor configured to:

sense a condition in the void of the body; and transmit a signal representing a value of the condition.

5. The wellhead adaptor tool of claim 4, wherein the sensor comprises a pressure sensor.

6. The wellhead adaptor tool of claim 1, wherein the void of the body is cylindrical.

7. The wellhead adaptor tool of claim 1, wherein an inner dimension of the void of the body is between 11 and 18 inches.

8. The wellhead adaptor tool of claim 1, wherein a pressure rating of the body is between 3000 and 15000 pounds per square inch.

9. The wellhead adaptor tool of claim 1, wherein the plurality of fasteners are at least one of bolts and nuts or studs and nuts.

10. A wellhead system comprising:

a wellhead of a wellbore, the wellhead comprising a rotating control device;

a shooting nipple configured to pass a well tool into the wellbore;

an adaptor tool configured to couple the shooting nipple to the rotating control device;

a clamp coupling the adaptor tool to the rotating control device;

a first sensor coupled to the adaptor tool, the first sensor configured to:

sense a condition of the adaptor tool; and transmit a signal representing a value of the condition of the adaptor tool;

a second sensor coupled to the rotating control device; the second sensor configured to:

sense a condition of the rotating control device; and transmit a signal representing a value of the condition of the rotating control device; and a controller configured to:

receive the signal representing the value of the condition of the adaptor tool from the first sensor;

receive the signal representing the value of the condition of the rotating control device from the second sensor;

compare the value of the condition of the adaptor tool, the value of the condition of the rotating control device, and a threshold value; and based on a result of the comparison, generate an alarm signal.

11. The wellhead system of claim 10, wherein the clamp comprises:

a first clamp portion;

a second clamp portion coupled to the first clamp portion; and a second plurality of fasteners coupling the first clamp portion to the second clamp portion.

12. The wellhead system of claim 10, wherein the adaptor tool comprises:

a body comprising a void;

a first flange coupled to a first portion of the body, the first flange configured to couple the body to the shooting nipple; and a second flange coupled to a second portion of the body, the second flange configured to couple the body to the rotating control device of the wellhead.

13. The wellhead system of claim 12, further comprising a metal to metal seal between the second flange of the adaptor tool, the clamp, and the rotating control device.

14. The wellhead system of claim 12, wherein the first flange comprises a plurality of voids, the wellhead system further comprises a plurality of fasteners to couple the shooting nipple to the adaptor tool.

15. The wellhead system of claim 10, wherein:

the first sensor comprises a pressure sensor, the condition of the adaptor tool comprises a pressure of the adaptor tool; and the second sensor comprises a pressure and temperature sensor, the condition of the rotating control device comprises a pressure and a temperature of the rotating control device.

16. The wellhead system of claim 15, wherein:

the first sensor is positioned in the adaptor tool to sense the condition of the adaptor tool in an uphole direction from a seal of the rotating control device; and the second sensor is positioned in the rotating control device to sense the condition of the rotating control device in a downhole direction from the seal of the rotating control device.

17. The wellhead system of claim 15, further comprising a display panel to display the pressure of the adaptor tool, the pressure of the rotating control device, the temperature of the rotating control device, and the alarm signal to an operator.

18. A method of installing a shooting nipple on a rotating control device of a wellhead, the method comprising:

receiving an adaptor tool on the rotating control device, the adaptor tool comprising:

a body comprising a void;

a first flange coupled to a first portion of the body, the first flange comprising a plurality of voids, the first flange configured to couple the body to the shooting nipple by a plurality of fasteners;

a second flange coupled to a second portion of the body, the second flange configured to couple the body to the rotating control device of the wellhead coupled to a wellbore;

coupling the adaptor tool to the rotating control device by a clamp; and coupling the shooting nipple to the adaptor tool by the plurality of fasteners.

19. The method of claim 18, wherein coupling the adaptor tool to the rotating control device by the clamp comprises:

separating a first clamp portion of the clamp from a second clamp portion of the clamp;

positioning the first clamp portion and the second clamp portion about a flange of the rotating control device and the second flange of the adaptor tool; and coupling the first clamp portion to the second clamp portion by a second plurality of fasteners.

20. The method of claim 18, further comprising:

receiving a signal representing a value of a condition of the adaptor tool;

receiving a signal representing a value of a condition of the rotating control device;

comparing the value of the condition of the adaptor tool, the value of the condition of the rotating control device, and a threshold value; and based on a result of the comparison, generating an alarm signal.

* * * * *